US009123478B2

(12) United States Patent
Esenwein et al.

(10) Patent No.: US 9,123,478 B2
(45) Date of Patent: Sep. 1, 2015

(54) POWER TOOL SWITCHING DEVICE

(71) Applicant: Robert Bosch GmbH, Stuttgart (DE)

(72) Inventors: Florian Esenwein, Uhingen-Holzhausen (DE); Manfred Lutz, Filderstadt (DE); Thomas Schomisch, Filderstadt (DE); Achim Trick, Sielmingen (DE)

(73) Assignee: Robert Bosch GmbH, Stuttgart (DE)

( * ) Notice: Subject to any disclaimer, the term of this patent is extended or adjusted under 35 U.S.C. 154(b) by 187 days.

(21) Appl. No.: 13/691,248

(22) Filed: Nov. 30, 2012

(65) Prior Publication Data

US 2013/0161166 A1 Jun. 27, 2013

(30) Foreign Application Priority Data

Dec. 23, 2011 (DE) ..... 10 2011 089 717

(51) Int. Cl.

| | |
|---|---|
| ***H01H 9/00*** | (2006.01) |
| ***H01H 3/20*** | (2006.01) |
| ***B25F 5/00*** | (2006.01) |
| ***B24B 23/02*** | (2006.01) |
| *H01H 9/06* | (2006.01) |

(52) U.S. Cl.

CPC ..... *H01H 9/00* (2013.01); *B24B 23/028* (2013.01); *B25F 5/00* (2013.01); *H01H 3/20* (2013.01); *H01H 9/06* (2013.01)

(58) Field of Classification Search

CPC ..... H01H 3/20; H01H 9/06

See application file for complete search history.

(56) References Cited

U.S. PATENT DOCUMENTS

| | | | | |
|---|---|---|---|---|
| 4,879,438 | A | 11/1989 | Winchester | |
| 6,489,578 | B1 * | 12/2002 | Jung et al. | 200/332.2 |

FOREIGN PATENT DOCUMENTS

| | | | |
|---|---|---|---|
| DE | 295 14 330 | U1 | 12/1995 |
| DE | 295 22 449 | U1 | 5/2005 |
| DE | 20 2008 002 672 | U1 | 11/2008 |
| DE | 10 2009 027 871 | A1 | 1/2011 |
| EP | 1 327 497 | A2 | 7/2003 |
| EP | 1 541 010 | A1 | 6/2005 |
| EP | 1 724 057 | A2 | 11/2006 |

* cited by examiner

*Primary Examiner* — Renee Luebke
*Assistant Examiner* — Ahmed Saeed
(74) *Attorney, Agent, or Firm* — Maginot, Moore & Beck LLP

(57) ABSTRACT

A power tool switching device, in particular for portable power tools, includes at least one switching unit having at least one movably mounted control element configured to actuate a mechanical, electrical and/or electronic switching element. The power tool switching device further includes at least one guide unit, which, upon an actuation of the control element along a direction of main extent of the control element, is configured to convert a movement of the control element along the direction of main extent at least into a movement of the control element running transversely in relation to the direction of main extent.

10 Claims, 7 Drawing Sheets

POWER TOOL SWITCHING DEVICE

This application claims priority under 35 U.S.C. §119 to patent application no. DE 10 2011 089 717.8, filed on Dec. 23, 2011 in Germany, the disclosure of which is incorporated herein by reference in its entirety.

BACKGROUND

There are already known power tool switching devices, in particular for portable power tools, that comprise a switching unit having a movably mounted control element for actuating a mechanical, electrical and/or electronic switching element.

SUMMARY

The disclosure is based on a power tool switching device, in particular for portable power tools, comprising at least one switching unit having at least one movably mounted control element for actuating a mechanical, electrical and/or electronic switching element.

It is proposed that the power tool switching device comprises at least one guide unit, which is provided, upon an actuation of the control element along a direction of main extent of the control element, to convert a movement of the control element along the direction of main extent at least into a movement of the control element running transversely in relation to the direction of main extent. The complete control element in this case can execute a movement along the direction of main extent and, consecutive thereto, a movement in a direction running transversely in relation to the direction of main extent, or the control element can execute a movement along the direction of main extent and, consecutively thereto, the control element can partially execute a movement in a direction running transversely in relation to the direction of main extent, such as, for example, a swivel movement about a swivel axis, in particular about a swivel axis running through the control element. The term "switching unit" is intended here to define, in particular, a unit provided to alter a state of a unit of higher order than the switching unit as a result of an actuation of at least the control element. Particularly preferably, the switching unit is provided to enable and/or interrupt an electrical power supply to a drive unit as a result of an actuation of the control element that acts upon the switching element of the switching unit, which switching element is realized as a mechanical, electrical and/or electronic switch and/or pushbutton. Preferably, the switching element realized as a mechanical, electrical and/or electronic switch and/or pushbutton is arranged in an electric circuit between an electrical power supply line such as, for example, a cable, on which there is a plug connector for connecting to a socket outlet, and a load such as, for example, a drive unit, realized as an electric motor, of the portable power tool. The term "provided" in this context is to be defined as specially designed and/or specially equipped. The expression "movably mounted" is intended here to define, in particular, a mounting of an element, the element, in particular decoupled from an elastic deformation of the element, having a capability to move along at least a travel distance greater than 1 mm, preferably greater than 2 mm, and particularly preferably greater than 5 mm, and/or a capability to move about at least one axis, by an angle greater than 2°, preferably greater than 5°, and particularly preferably greater than 10°.

A "guide unit" is to be understood here to be, in particular, a unit provided to guide a component during a movement in a plane along a defined path, by exerting at least one constraining force transversely in relation to a direction of movement.

A "constraining force" is to be understood here to be, in particular, a force provided to prevent a component from moving in at least one direction and/or to keep the component, during a movement, on a path defined through exertion of the force upon the component. Preferably, the control element extends over at least a major part of a total length of a rod-shaped housing region of a power tool housing of the portable power tool, the total length running at least substantially parallel in relation to the direction of main extent, thereby enabling quite particularly secure and comfortable operation to be achieved by simple design means. In particular, the control element extends along 30% of the total length of the rod-shaped housing region, preferably along 50%, and particularly preferably along 75%. The rod-shaped housing region of the power tool housing of the portable power tool preferably constitutes a handle region that is gripped, or grasped, by an operator's hand for the purpose of operation and/or handling during machining of a workpiece by means of the portable power tool.

The expression "direction of main extent" is intended here to define, in particular, a direction along which a component has a maximum extent, the direction being realized, in particular, so as to be other than a diagonal and running at least substantially parallel to at least two edges of the component that delimit side walls of the component that face away from and are spaced apart from each other. Preferably, the direction of main extent of the control element, when mounted in the portable power tool, runs at least substantially parallel to a drive axis of the drive unit of the portable power tool. "Substantially parallel" is to be understood here to mean, in particular, an alignment of a direction relative to a reference direction, in particular in one plane, the direction deviating from the reference direction by, in particular, less than 8°, advantageously less than 5°, and particularly advantageously less than 2°. Preferably, the control element has two degrees of freedom, owing to guidance by means of the guide unit. Upon an actuation of the control element along the direction of main extent, the control element is preferably initially moved translationally along the direction of main extent, owing to the guidance by the guide unit, and then, owing to the guidance by means of the guide unit, swiveled into a direction running transversely in relation to the direction of main extent, and/or the control element executes a translational movement on which a swiveling movement is superimposed. By this means, advantageously, the control element can be made comfortable to operate. In addition, advantageously, it is possible to prevent a portable power tool, having the power tool switching device according to the disclosure, from being inadvertently started up as a result of a region of the portable power tool in which the control element is arranged being grasped by an operator's hand, and therefore to prevent an actuating force, running at least substantially perpendicular to the direction of main extent, from being exerted. Further, by means of a movement capability of the control element that is defined by the guide unit, in particular owing to the swiveling movement of the control element, in the direction of the switching element, that follows an initially translational movement in the case of an actuation of the control element, it is possible, advantageously, through a compressive force already being generated when the handle region is being grasped, for the control element to be comfortably held in a position of the control element that corresponds to the portable power tool being in a switched-on state.

Furthermore, it is proposed that the switching unit has at least one blocking element, which is provided to block a movement of the control element in at least one direction, in at least one operating state. A "blocking element" is to be understood here to be, in particular, an element provided to prevent, insofar as possible, a movement of a movably mounted component along at least one travel distance and/or about at least one axis by means of a mechanical, electrical and/or electronic blocking means, in at least one operating state. Preferably, the blocking element is provided to prevent, insofar as possible, a movement of the movably mounted control element by means of a mechanical blocking means, in at least one operating state. It is also conceivable, however, for the blocking element to prevent, insofar as possible, a movement of the control element by means of action of an electromagnetic force and/or action of a permanent-magnet force upon the control element such as, for example, by means of displaceable magnets, in at least one operating state. The blocking element is therefore preferably realized as a mechanical blocking element that is provided, as a result of a direct contact, with a stop of the switching unit that is arranged in the power tool housing of the portable power tool, when in a blocking position, to block a movement of the control element. It is also conceivable, however, for the switching unit to comprise a multiplicity of blocking elements, which are provided to block a movement of the control element by means of stops of the switching unit that are arranged in the power tool housing of the portable power tool. A number of stops arranged in the power tool housing preferably corresponds to a number of blocking elements. The blocking elements in this case can be arranged with an even and/or uneven distribution on the control element and/or on the power tool housing. Particularly preferably, the blocking element is movably mounted on the control element. The design according to the disclosure, advantageously, in addition to preventing inadvertent startup of the portable power tool, by means of the movement capability of the control element defined by the guide unit, achieves a high degree of protection against inadvertent startup of the portable power tool. Advantageously, therefore, it is possible to achieve a high degree of protection against injury to an operator resulting from inadvertent startup of the portable power tool.

Advantageously, the switching unit has at least one spring element, which is provided to apply a spring force to the control element in at least one operating position. Particularly preferably, the spring element is provided to apply a spring force to the control element in the direction of an initial position of the control element. Preferably, an electrical power supply to the drive unit is interrupted when the control element is in an initial position, owing to the switching element not being actuated. A "spring element" is to be understood to be, in particular, a macroscopic element having at least one extent that, in a normal operating state, can be varied elastically by at least 10%, in particular by at least 20%, preferably by at least 30%, and particularly advantageously by at least 50% and that, in particular, generates a counterforce, which is dependent on a variation of the extent and preferably proportional to the variation and which counteracts the variation. An "extent" of an element is to be understood to be, in particular, a maximum distance of two points of a perpendicular projection of the element on to a plane. A "macroscopic element" is to be understood to be, in particular, an element having an extent of at least 1 mm, in particular of at least 5 mm, and preferably of at least 10 mm. Advantageously, it is possible to achieve an automatic movement of the control element into an operating position, in particular into an initial position. Particularly advantageously, therefore, a watchdog circuit can be achieved. A "watchdog" circuit is to be understood to be, in particular, a circuit that automatically deactivates the portable power tool in the case of a termination of an intentional activation of the portable power tool, for example in the case of unconsciousness and/or in the case of an intentional interruption of application of an actuating force upon the control element.

Further, it is proposed that the guide unit is realized as a slideway guide unit and/or as a pendulum rod guide unit. A "slideway guide unit" is to be understood here to be, in particular, a guide unit that, as a result of a bolt-shaped element engaging in a slideway realized as a control recess, defines, or controls, a movement capability and/or movement direction of a component. The term "pendulum rod guide unit" is intended here to define, in particular, a guide unit that, as a result of a rigid guide element being movably mounted on two components that are movable relative to each other, defines, or controls, a movement capability and/or movement direction. By simple design means it is possible for a movement of the control element along one direction to be converted into a movement of the control element in a further direction.

Particularly preferably, the guide unit has at least one guide element, which is provided to mount the control element in a swiveling manner. Preferably, a swivel axis runs at least substantially perpendicular to the direction of main extent of the control element. Particularly preferably, the guide element is provided to mount the control element in a swiveling manner when the control element is in an operating state in which a pure translational movement of the control element along the direction of main extent that prevails at the start of an actuation of the control element has been completed and/or in which, in particular, a translational movement and a swiveling movement are superimposed on each other. The design according to the disclosure advantageously enables the control element to be swiveled in, in order that an operator can comfortably hold the control element in an operating position of the control element that corresponds to the portable power tool being in a switched-on state.

In addition, it is proposed that the guide unit has at least one further guide element, realized as a groove, which has a guide track course that is at least partially angled relative to the direction of main extent of the control element, at least when the control element is in an initial position. The guide track course and the direction of main extent in this case preferably enclose an angle other than 90° and 180°. A "guide track course" is to be understood here to be, in particular, a course of a track, in particular of the groove, which defines a movement path of the control element during a movement, the course of the path being constituted by peripheral regions of the track, in particular of the groove, that run at least substantially parallel to each other and delimit the track. The guide element, realized as a groove, is preferably arranged in an inside of the power tool housing of the portable power tool that faces toward the control element. Arranged on the control element in this case, preferably, is at least one bolt-shaped engagement element of the guide unit, which engages in the guide element, realized as a groove, for the purpose of guiding the control element. Preferably, the engagement element is integrally formed on to the control element. It is also conceivable, however, for the engagement element to be realized separately from the control element and to be fixedly connected to the control element by means of a connection type considered appropriate by persons skilled in the art, such as, for example, a positive and/or non-positive connection type. In addition, however, it is also conceivable for the guide element, realized as a groove, to be arranged on the control element, and for the engagement element to be arranged on the inside of the power tool housing. The design according to the disclosure, by simple design means, makes it possible for a translational movement along the direction of main extent to be converted into a direction running transversely in relation to the direction of main extent.

Furthermore, it is proposed that the guide unit has at least one guide element realized as a pendulum rod. The expression "pendulum rod" is intended here to define, in particular, an element, in particular a rigid element, that is mounted in the manner of a linkage at two ends of the element that face away from each other. Advantageously, a movable mounting of the control element can be achieved at low cost. In addition, advantageously, it can be ensured that the control element can be moved when being used in very dirty environments such as, for example, environments that contain large amounts of dust or material removed from workpieces.

Advantageously, the control element has at least two ends that face away from each other, as viewed along the direction of main extent, at least one guide element of the guide unit being arranged at one end, and at least one further guide element of the guide unit being arranged at a further end that faces away from the end, when the control element is in the mounted state. Preferably, two guide elements of the guide unit are arranged at the end, and two further guide elements of the guide unit are arranged at the further end. The guide elements and the further guide elements are preferably realized as grooves, in which there engage engagement elements of the guide unit that are fixedly connected to the control element, for the purpose of guiding the control element, and/or the guide elements and the further guide elements are realized as pendulum rods, which are movably mounted on the control element. Advantageously, precise guidance of the control element during a movement can be achieved. In addition, in particular if two guide elements are arranged at one end and two further guide elements are arranged at the further end of the control element, it is possible to achieve an advantageously symmetrical arrangement of the guide elements and/or of the further guide elements on and/or in the power tool housing of the portable power tool, to enable the control element to be guided in an advantageously stable manner during a movement.

Further, the disclosure is based on a portable power tool having a power tool switching device according to the disclosure. A "portable power tool" is to be understood here to be, in particular, a power tool for machining of workpieces, that can be transported by an operator without a transport machine. The portable power tool has, in particular, a mass of less than 40 kg, preferably less than 10 kg, and particularly preferably less than 5 kg. Particularly preferably, the portable power tool is realized as an angle grinder. It is also conceivable, however, for the portable power tool to be of a different design, considered appropriate by persons skilled in the art, such as being designed, for example, as a manual planing machine, as a multifunction power tool, as a portable milling machine, as a grinding machine and/or as an electrically operated garden appliance. Advantageously, a high degree of operating comfort can be achieved for an operator of the portable power tool.

The power tool switching device according to the disclosure and/or the power tool according to the disclosure in this case is/are not intended to be limited to the application and embodiment described above. In particular, for the purpose of fulfilling a mode of operation described herein, the power tool switching device according to the disclosure and/or the power tool according to the disclosure can have a number of individual elements, components and units that differs from a number stated herein.

BRIEF DESCRIPTION OF THE DRAWINGS

Further advantages are given by the following description of the drawings. The drawings show exemplary embodiments of the disclosure. The drawings, the description, and the claims contain numerous features in combination. Persons skilled in the art will also expediently consider the features individually and combine them to create appropriate further combinations.

In the drawings.

DETAILED DESCRIPTION

Figure 1:
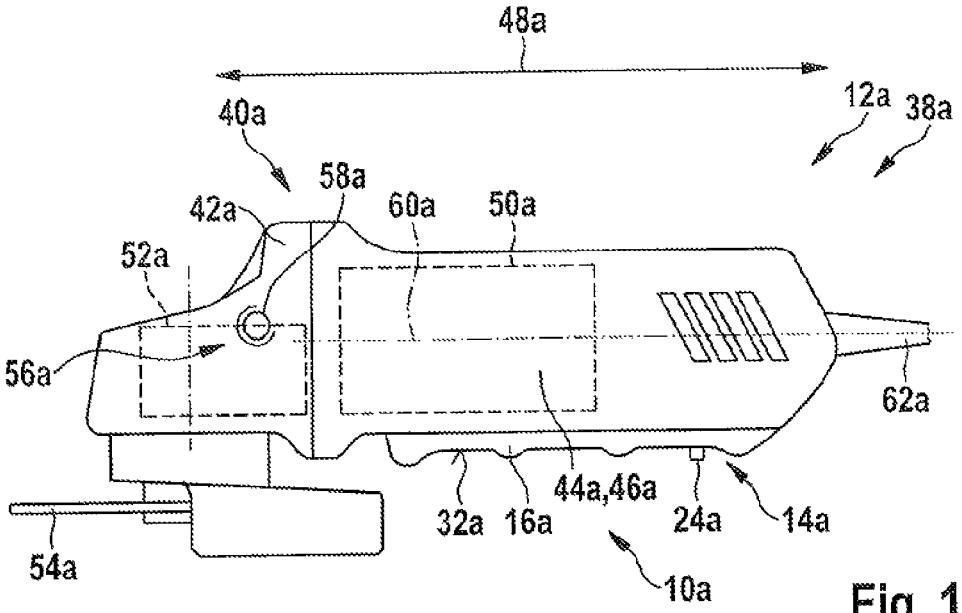
FIG. 1 shows, in a schematic representation, a portable power tool according to the disclosure comprising a power tool switching device according to the disclosure.

FIG. 1 shows a portable power tool 12*a*, realized as an angle grinder 38*a*, comprising a power tool switching device 10*a*. The angle grinder 38*a* has a power tool housing 40*a*, which comprises a transmission housing 42*a* and a motor housing 44*a*. The power tool housing 40*a* is of a pot-type design. It is also conceivable, however, for the power tool housing 40*a* to be of a shell-type design, or a combination of a pot-type and shell-type design. Further, the angle grinder 38*a* has a main handle 46*a*, which is constituted by the motor housing 44*a*. The main handle 46*a*, starting from the transmission housing 42*a*, extends in a direction that faces away from the transmission housing 42*a* and that runs at least substantially parallel to a direction of main extent 48*a* of the angle grinder 38*a*. The main handle 46*a* in this case has an at least substantially cylindrical shape. It is also conceivable, however, for the main handle 46*a* to have a different shape, considered appropriate, in particular ergonomically appropriate, by persons skilled in the art.

The motor housing 44*a* is provided to receive a drive unit 50*a* of the angle grinder 38*a*. The transmission housing 42*a* is provided to receive an output unit 52*a* of the angle grinder 38*a*, which output unit comprises a drive spindle (not represented in greater detail here) for driving a machining tool 54*a* in rotation. An auxiliary-handle fastening device 56*a* is arranged on the transmission housing 42*a*. The auxiliary-handle fastening device 56*a* has a multiplicity of auxiliary-handle receiving elements 58*a* (only one auxiliary-handle receiving element 58*a* can be seen in FIG. 1), which are arranged in an evenly distributed manner along a circumferential direction on the transmission housing 42*a*. The auxiliary-handle receiving elements 58*a* are provided to receive a fastening region of a removable auxiliary handle (not represented in greater detail here). The fastening region of the auxiliary handle can be screwed into the auxiliary-handle receiving elements 58*a*, for example by means of a screwed connection, for the purpose of fixing the auxiliary handle to the transmission housing 42*a*. When the fastening region of the auxiliary handle is in a mounted state in an auxiliary-handle receiving element 58*a*, the auxiliary handle extends transversely in relation to the direction of main extent 48*a* of the angle grinder 38*a*.

Figure 2:
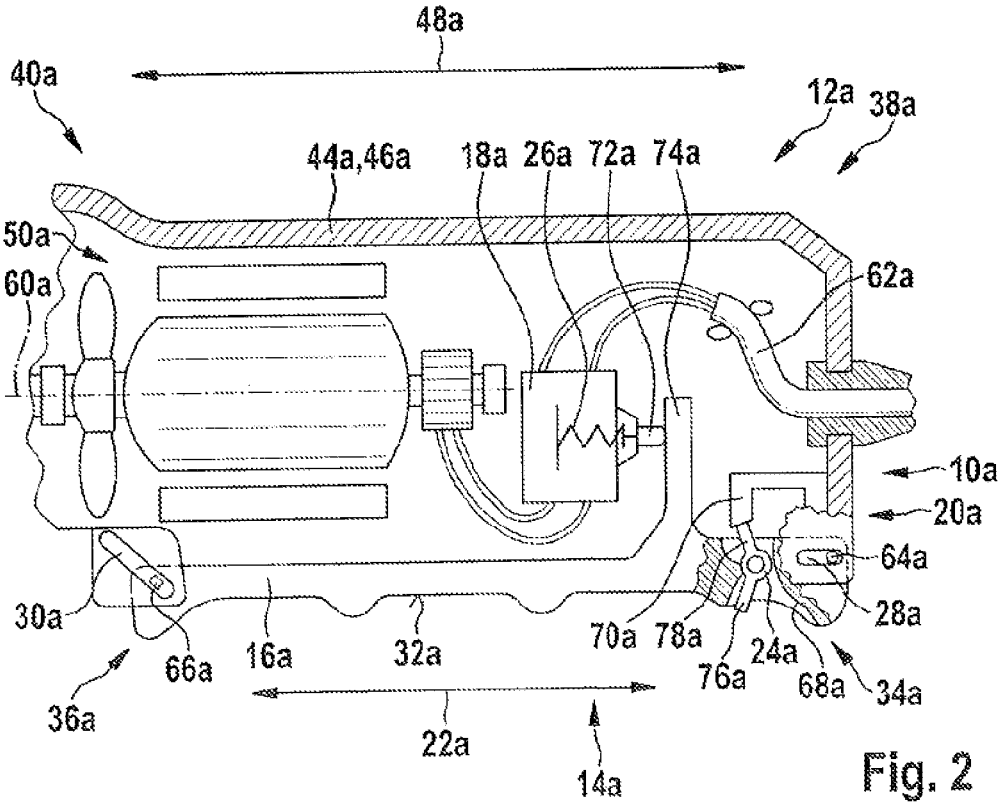
FIG. 2 shows, in a schematic representation, a detail view of the power tool switching device according to the disclosure, when a control element of a switching unit of the power tool switching device according to the disclosure is in an initial position.

FIG. 2 shows a detail view of the power tool switching device 10*a* when a control element 16*a* of a switching unit 14*a* of the power tool switching device 10*a* is in an initial position. The power tool switching device 10*a* thus comprises at least the switching unit 14*a*, which comprises at least the movably mounted control element 16*a* for actuating a mechanical, electrical and/or electronic switching element 18*a* of the switching unit 14*a*. The switching unit 18*a* is electrically connected to a power supply cable 62*a* and to the drive unit 50*a*, in a manner already known to persons skilled in the art. The switching element 18*a* is thus provided, when in a non-actuated state, to break an electric circuit for supplying electrical power to the drive unit 50*a* and, when in an actuated state, to close the electric circuit for supplying electrical power to the drive unit 50*a*. When the control element 16*a* is in the initial position, the switching element 18*a* is not being actuated by the control element 16*a*. In this case, an electrical power supply to the drive unit 50*a* is interrupted when the control element 16*a* is in the initial position. Thus, when the control element 16*a* is in the initial position, no electric current is supplied to the drive unit 50*a*.

The control element 16*a* is arranged on the main handle 46*a*, on a side of the main handle 46*a* that faces toward the drive spindle. Alternatively, the control element 16*a* could also be arranged on a side of the main handle 46*a* that faces away from the drive spindle, or on another side considered appropriate by persons skilled in the art. In particular, the main handle 46*a* could be mounted so as to be rotatable relative to the transmission housing 42*a*. The control element 16*a* extends along the direction of main extent 22*a* of the control element 16*a* on the main handle 46*a*, or on the motor housing 44*a*. A total extent of the control element 16*a* along the direction of main extent 22*a* corresponds in this case to approximately 80% of a total extent of the main handle 46*a* along the direction of main extent 48*a* of the angle grinder 38*a*. The control element 16*a* has a control surface 32*a* having an at least substantially rectangular projection surface. The switching element 18*a* is arranged in the interior space enclosed by the main handle 46*a*, or by the motor housing 44*a*. The switching element 18*a* in this case is arranged in a region of the interior space that is arranged on a side of the main handle 46*a*, or of the motor housing 44*a*, that faces away from the transmission housing 42*a*. It is also conceivable, however, for the switching element 18*a* to be arranged at a different position, considered appropriate by persons skilled in the art, in and/or on the main handle 46*a*, or on the motor housing 44*a*.

For the purpose of movable mounting and guidance during a movement of the control element 16*a*, the power tool switching device 10*a* has at least one guide unit 20*a*. The guide unit 20*a* is provided, upon an actuation of the control element 16*a* along a direction of main extent 22*a* of the control element 16*a*, to convert a movement of the control element 16*a* along the direction of main extent 22*a* at least into a movement of the control element 16*a* running transversely in relation to the direction of main extent 22*a*. The direction of main extent 22*a* of the control element 16*a* in this case, when the control element 16*a* is in the initial position, runs at least substantially parallel to the direction of main extent 48*a* of the angle grinder 38*a*. In addition, the direction of main extent 22*a* of the control element 16*a*, when the control element 16*a* is in the initial position, runs at least substantially parallel to a drive axis 60*a* of the drive unit 50*a*. The control element 16*a* has at least two ends 34*a*, 36*a* that face away from each other, as viewed along the direction of main extent 22*a*, at least one guide element 28*a* of the guide unit 20*a* being arranged at an end 34*a* of the control element 16*a* that faces away from the transmission housing 42*a*, and at least one further guide element 30*a* of the guide unit 20*a* being arranged at a further end 36*a* of the control element 16*a* that faces away from the end 34*a* and toward the transmission housing 42*a*, when the control element 16*a* is in a mounted state.

The guide unit 20*a* has a total of two guide elements 28*a*, which are arranged at the end 34*a* of the control element 16*a* that faces away from the transmission housing 42*a*, and two further guide elements 30*a*, which are arranged at the further end 36*a* of the control element 16*a* that faces toward the transmission housing 42*a* (FIG. 2 shows only one of the two guide elements 28*a* and one of the two further guide elements 30*a*). The two guide elements 28*a* are similar to each other in shape. Further, the two further guide elements 30*a* are likewise similar to each other in shape. In this case, respectively one of the two guide elements 28*a* and one of the two further guide elements 30*a* are arranged in a common plane, which runs at least substantially perpendicular to the control surface 32*a* of the control element 16*a*. The guide element that is not represented and the further guide element that is not represented are arranged in a further common plane that runs at least substantially parallel to the common plane of the represented guide element 28*a* and of the further represented guide element 30*a* (cf. in this respect also FIG. 7, which shows an alternative exemplary embodiment of the power tool switching device 10*a*). The common plane of the represented guide element 28*a* and of the further represented guide element 30*a* is represented in FIG. 2 by the plane of the figure, the further common plane being arranged along a direction that runs at least substantially perpendicular to the plane of the figure, in particular into the plane of the figure, at a distance from the common plane of the represented guide element 28*a* and of the further represented guide element 30*a*. The guide elements 28*a* and the further guide elements 30*a* are each realized as a groove, which grooves are arranged on an inside of the main handle 46*a*, or of the motor housing 44*a*, that faces toward the control element 16*a*. It is conceivable for the guide elements 28*a*, realized as grooves, and the further guide elements 30*a*, realized as grooves, to be open on one side for the purpose of mounting the control element 16*a*.

The further guide elements 30*a* realized as grooves each have a guide track course that is at least partially angled relative to the direction of main extent 22*a* of the control element 16*a*, at least when the control element 16*a* is in the initial position. In this case, the further guide elements 30*a* realized as grooves enclose with the direction of main extent 22*a* of the control element 16*a* an angle other than 90° and 180° when the control element 16*a* is in the initial position. Further, the guide track course of the further guide elements 30*a* realized as grooves are aligned obliquely relative to the drive axis 60*a* of the drive unit 50*a*. The guide elements 28*a* arranged at the end 34*a* of the control element 16*a* that faces away from the transmission housing 42*a* each have a guide track course that extends at least substantially parallel to the direction of main extent 22*a* of the control element 16*a* when the control element 16*a* is in the initial position. The guide elements 28*a* realized as grooves thus run at least substantially parallel to the drive axis 60*a* of the drive unit 50*a*.

For the purpose of movably mounting and guiding the control element 16*a* by means of the guide unit 20*a*, the guide unit 20*a* comprises engagement elements 64*a*, 66*a*, which are fixed to the control element 16*a*. The guide unit 20*a* has a total of four engagement elements 64*a*, 66*a*, which are fixed to the control element 16*a* (FIG. 2 shows only two of the four engagement elements 64*a*, 66*a*, the engagement elements that are not shown being arranged in a mirror-image manner on a plane on the control element 16*a* that runs at least substantially perpendicular to the control surface 32*a*). The engagement elements 64*a*, 66*a* are realized so as to be integral with the control element 16*a*. It is also conceivable, however, for the engagement elements 64*a*, 66*a* to be fixed to the control element 16*a* by means of a positive and/or non-positive connection. When the control element 16*a* is in a mounted state, the engagement elements 64*a*, 66*a* each engage in one of the guide elements 28*a* or in one of the further guide elements 30*a*. The engagement elements 64*a*, 66*a* in this case are realized as guide bolts, which have a cylindrical cross section. It is also conceivable, however, for the engagement elements 64*a*, 66*a* to be of a different shape, considered appropriate by persons skilled in the art. The guide unit 20*a* is thus realized as a slideway guide unit.

Furthermore, the switching unit 14*a* has at least one blocking element 24*a*, which is provided to block a movement of the control element 16*a* in at least one direction, in at least one operating state. The blocking element 24*a* is mounted in a swiveling manner on the control element 16*a*. The blocking element 24*a* in this case is arranged with spring bias in a recess 68*a* of the control element 16*a*. The blocking element 24*a* acts in combination with a stop element 70*a* of the switching unit 14*a* for the purpose of blocking a movement of the control element 16*a* along the direction of main extent 22*a* of the control element 16*a*. The stop element 70*a* is integrally formed on to the inside of the motor housing 44*a*, or of the main handle 46*a*, that faces toward the control element 16*a*. When the blocking element 24*a* is in a blocking position, the blocking element 24*a* thus, via the stop element 70*a*, supports an actuating force, which acts upon the control element 16*a*, on the motor housing 44*a*, or on the main handle 46*a*. For the purpose of releasing the blocking position, the blocking element 24*a* is swiveled about a swivel axis, contrary to a spring force, by an operator. The blocking element 24*a* has two limbs that extend in directions facing away from the swivel axis. One limb of the blocking element 24*a* in this case is realized as an actuating limb 76*a*, which can be actuated by an operator, and one limb is realized as a blocking limb 78*a*, which bears against the stop element 70*a* when in the blocking position. The actuating limb 76*a* and the blocking limb 78*a* are each directly connected to the swivel axis. The blocking limb 78*a* is formed on to the actuating limb 76*a*, on a side of the actuating limb 76*a* that faces toward the swivel axis. Further, the actuating limb 76*a* and the blocking limb 78*a* each extend obliquely in relation to the direction of main extent 22*a* of the control element 16*a* when the blocking element 24*a* is in the blocking position and in a release position.

In addition, the switching unit 14*a* comprises at least one spring element 26*a*, which is provided to apply a spring force to the control element 16*a* in at least one operating position. The spring element 26*a* is realized as a compression spring. It is also conceivable, however, for the spring element 26*a* to be of a different design, considered appropriate by persons skilled in the art, such as, for example, designed as a tension spring, torsion spring, etc. The spring element 26*a* is provided to apply a spring force to the control element 16*a* in the direction of the initial position of the control element 16*a*. The spring element 26*a* in this case is a component of the switching element 18*a*, which component is provided to apply a spring force to an actuating striker 72*a* of the switching element 18*a* in the direction of a position of the switching element 18*a* that corresponds to a non-actuated state of the switching element 18*a*. It is also conceivable, however, for the spring element 26*a* to be realized separately from the switching element 18*a* and, for the purpose of applying a spring force to the control element 16*a*, to be supported by one end on the inside of the motor housing 44*a*, or of the main handle 46*a*, that faces toward the control element 16*a* and to be supported on the control element 16*a* by a further end.

Figure 3:
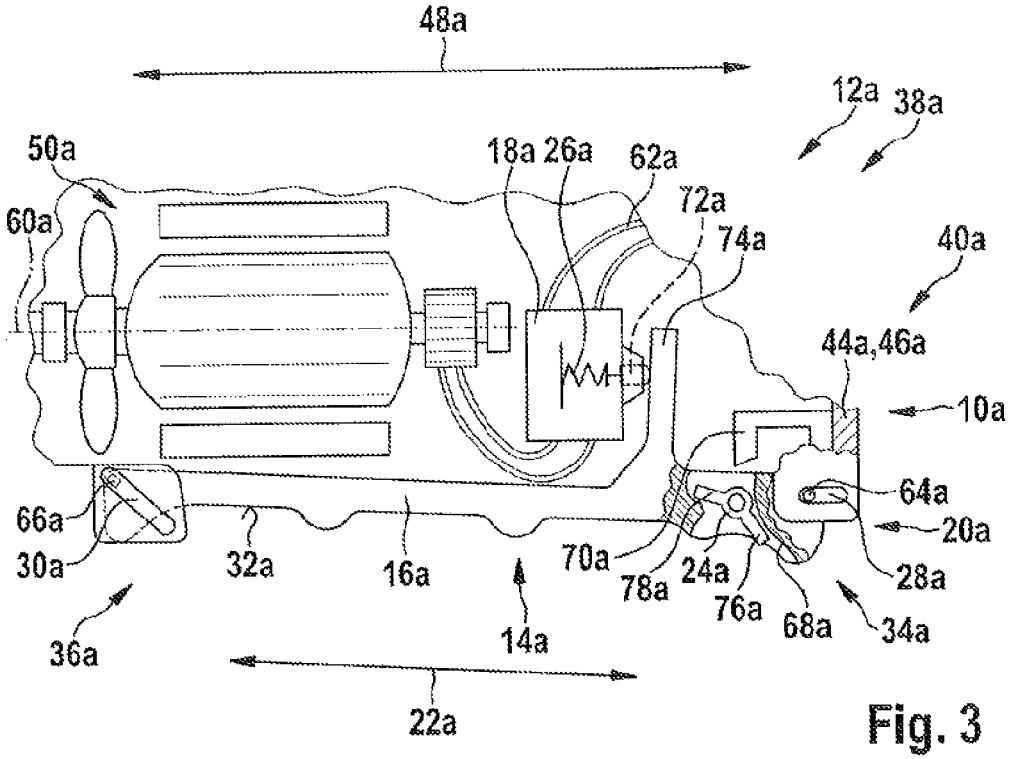
FIG. 3 shows, in a schematic representation, a detail view of the power tool switching device according to the disclosure, when the control element is in a switch-on position.

Upon an actuation of the control element 16*a*, starting from the initial position of the control element 16*a*, by means of application of force by an operator in the direction of the direction of main extent 22*a* of the control element 16*a*, the control element 16*a*, after release of the blocking position of the blocking element 24*a* as a result of the guidance by the guide unit 20*a*, executes a movement parallel to the direction of main extent 22*a* of the control element 16*a*, which movement is superimposed by a swivel movement about a swivel axis of the control element 16*a* that runs at least substantially perpendicular to the direction of main extent 22*a* of the control element 16*a*. The control element 16*a* is swiveled about the swivel axis, in a direction facing toward the motor housing 44*a*, or the main handle 46*a*. As a result of an actuation, therefore, the control element 16*a* goes at least partially into the motor housing 44*a*, or into the handle 46*a*. The control element 16*a* is thus moved from the initial position into a switch-on position (FIG. 3). In this case, the engagement elements 64*a*, 66*a* slide on peripheral regions of the guide elements 28*a*, realized as grooves, and on peripheral regions of the further guide elements 30*a*, realized as grooves.

The guide elements 28*a* arranged at the end 34*a* of the control element 16*a* that faces away from the transmission housing 42*a*, together with the engagement elements 64*a* that engage in the guide elements 28*a*, are provided to mount the control element 16*a* in a swiveling manner. The guide unit 20*a* therefore comprises at least the guide elements 28*a* provided for mounting the control element 16*a* in a swiveling manner. When the control element 16*a* is in the switch-on position, the actuating striker 72*a* of the switching element 18*a* is actuated by means of an actuating extension 74*a* of the control element 16*a* (FIG. 3). The actuating extension 74*a* is arranged on a side of the control element 16*a* that faces away from the control surface 32*a*. The actuating extension 74*a* in this case extends, at least substantially perpendicular to the direction of main extent 22*a* of the control element 16*a*, in a direction that faces away from the control element 16*a*. When the control element 16*a* is in the switch-on position, the electric circuit for supplying electrical power to the drive unit 50*a* is closed as a result of the actuation of the switching element 18*a*. As soon as a force applied to the control element 16*a* by an operator is interrupted, or falls below a minimum value, the control element 16*a* is moved into the initial position by means of a spring force of the spring element 26*a*. The blocking element 24*a*, as a result of being mounted with spring bias in the control element 16*a*, is moved into the blocking position when the initial position of the control element 16*a* is attained. A movement of the control element 16*a* in the direction of the switch-on position is thus blocked by means of a combined action of the blocking element 24*a* and the stop element 70*a*.

Alternative exemplary embodiments are represented in FIGS. 4 to 12. Components, features and functions that remain substantially the same are denoted essentially by the same references. In order to differentiate the exemplary embodiments, the letters a to f are added as a suffix to the references of the exemplary embodiments. The description that follows is restricted substantially to the differences in comparison with the first exemplary embodiment in FIGS. 1 to 3, and reference may be made to the description of the first exemplary embodiment in FIGS. 1 to 3 in respect of components, features and functions that remain the same.

Figure 4:
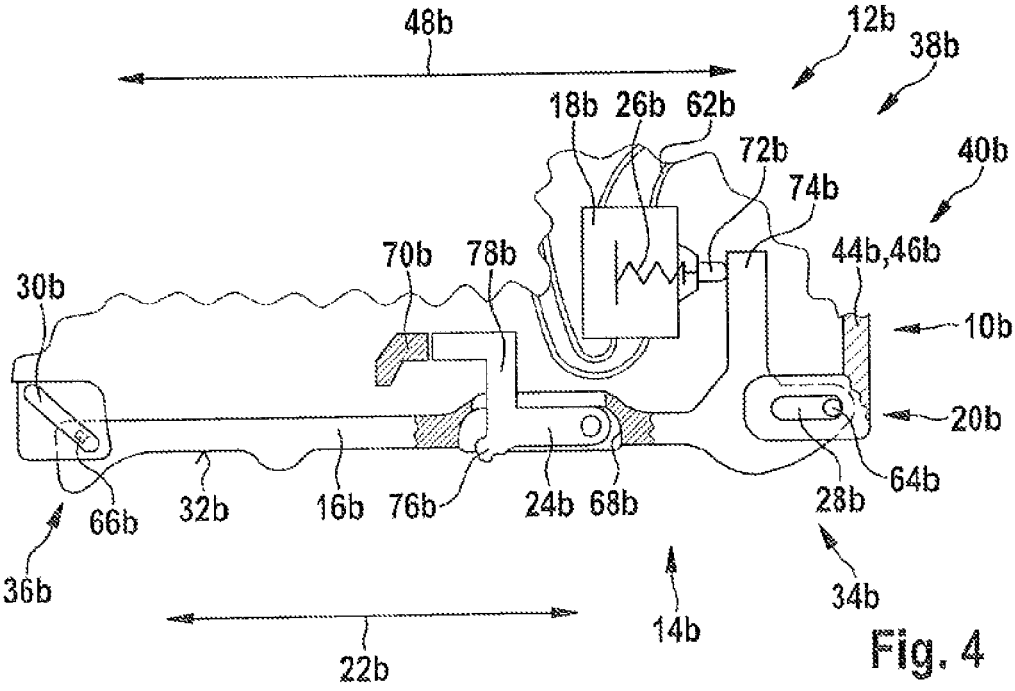
FIG. 4 shows, in a schematic representation, a detail view of an alternative power tool switching device according to the disclosure, when a control element of a switching unit of the alternative power tool switching device according to the disclosure is in an initial position.

FIG. 4 shows a detail view of an alternative power tool switching device 10*b* when a control element 16*b* of a switching unit 14*b* of the power tool switching device 10*b* is in an initial position. The power tool switching device 10*b* in this case is arranged in an angle grinder 38*b*, which comprises the power tool switching device 10*b*. The angle grinder 38*b* is of a structure similar to that of the angle grinder 38*a* from FIG. 1. The power tool switching device 10*b* comprises at least the switching unit 14*b*, which comprises at least the movably mounted control element 16*b* for the purpose of actuating a mechanical, electrical and/or electronic switching element 18*b* of the switching unit 14*b*. In addition, the power tool switching device 10*b* has a guide unit 20*b*, which is provided, upon an actuation of the control element 16*b* along a direction of main extent 22*b* of the control element 16*b*, to convert a movement of the control element 16*b* along the direction of main extent 22*b* at least into a movement of the control element 16*b* running transversely in relation to the direction of main extent 22*b*. In respect of a design of the guide unit, reference may be made to the guide unit 20*a* described in FIGS. 1 to 3, since the guide unit 20*b* is of a design similar to that of the guide unit 20*a* described in FIGS. 1 to 3.

Figure 5:
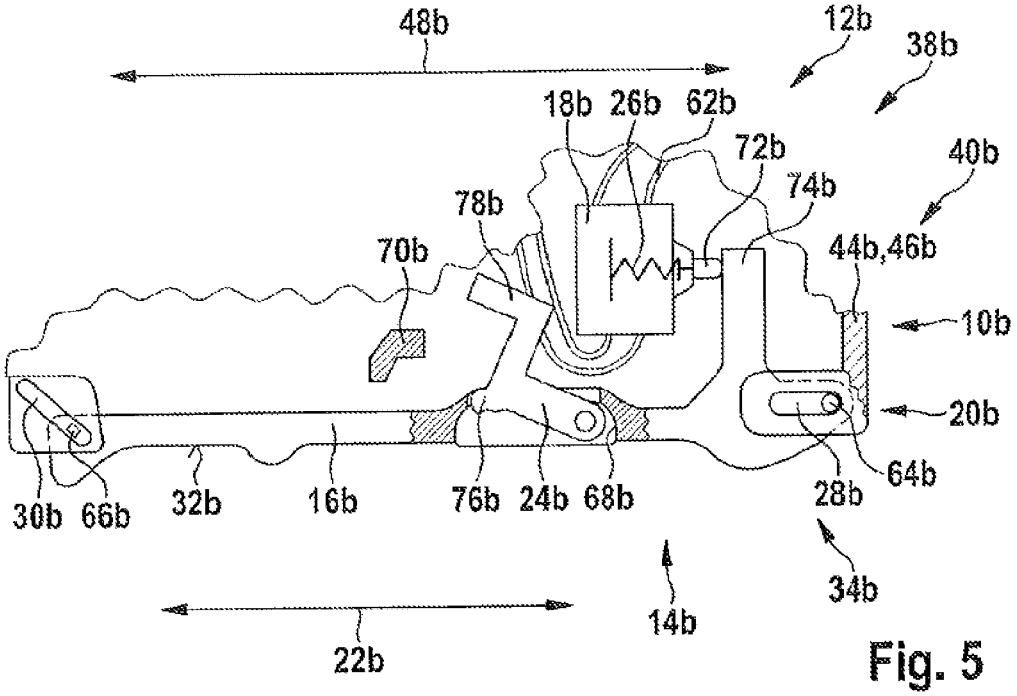
FIG. 5 shows, in a schematic representation, a detail view of the alternative power tool switching device according to the disclosure from FIG. 4, when the control element is in the initial position, with a blocking element of the switching unit in a release position.

The switching unit 14*b* has at least one blocking element 24*b*, which is provided to block a movement of the control element 16*b* in at least one direction, in at least one operating state. The blocking element 24*b* is mounted in a swiveling manner on the control element 16*b*. The blocking element 24*b* in this case is arranged with spring bias in a recess 68*b* of the control element 16*b*. The blocking element 24*b* acts in combination with a stop element 70*b* of the switching unit 14*b* for the purpose of blocking a movement of the control element 16*b* along the direction of main extent 22*b* of the control element 16*b*. The stop element 70*b* is integrally formed on to the inside of a motor housing 44*b*, or of a main handle 46*b*, of the angle grinder 38*b* that faces toward the control element 16*b*. The blocking element 24*b* has an actuating limb 76*b*, which can be actuated by an operator, and has a blocking limb 78*b*, which bears against the stop element 70*b* when in a blocking position. The blocking limb 78*b* is realized so as to be integral with the actuating limb 76*b*. The blocking limb 78*b* in this case is of an L-shaped design. The blocking limb 78*b* is formed on to the actuating limb 76*b*, on a side of the blocking element 24*b* that faces away from a swivel axis. In addition, the blocking limb 78*b* is connected to the swivel axis via the actuating limb 76*b*. Further, when the blocking element 24*b* is in the blocking position, the actuating limb 76*b* and a blocking region of the blocking limb 78*b* extend at least substantially parallel to the direction of main extent 22*b* of the control element 16*b*. For the purpose of releasing the blocking position of the blocking element 24*b*, an operator exerts upon the blocking element 24*b* a force acting at least substantially perpendicular to a control surface 32*b* of the control element 16*b*. As a result, the blocking element 24*b* is swiveled in the direction of an interior space enclosed by the motor housing 44*b*, or by the main handle 46*b* (FIG. 5).

Figure 6:
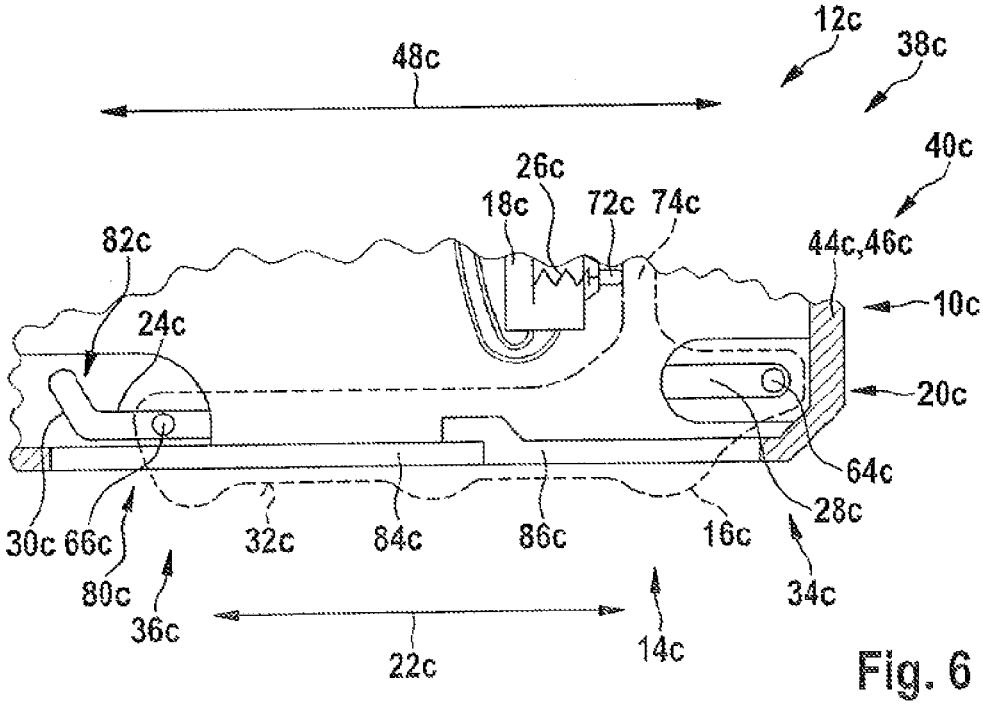
FIG. 6 shows, in a schematic representation, a detail view of a further alternative power tool switching device according to the disclosure, when a control element of a switching unit of the alternative power tool switching device according to the disclosure is in an initial position.

FIG. 6 shows a detail view of a further alternative power tool switching device 10*c*. The power tool switching device 10*c* in this case is arranged in an angle grinder 38*c*, which comprises the power tool switching device 10*c*. The angle grinder 38*c* is of a structure at least substantially similar to that of the angle grinder 38*a* from FIG. 1. The power tool switching device 10*c* is of a design at least substantially similar to that of the power tool switching device 10*a* described in the description of FIGS. 1 to 3. Only a guide unit 20*c* of the power tool switching device 10*c* is of a design that differs from that of the power tool switching device 10*a* described in the description of FIGS. 1 to 3.

Figure 7:
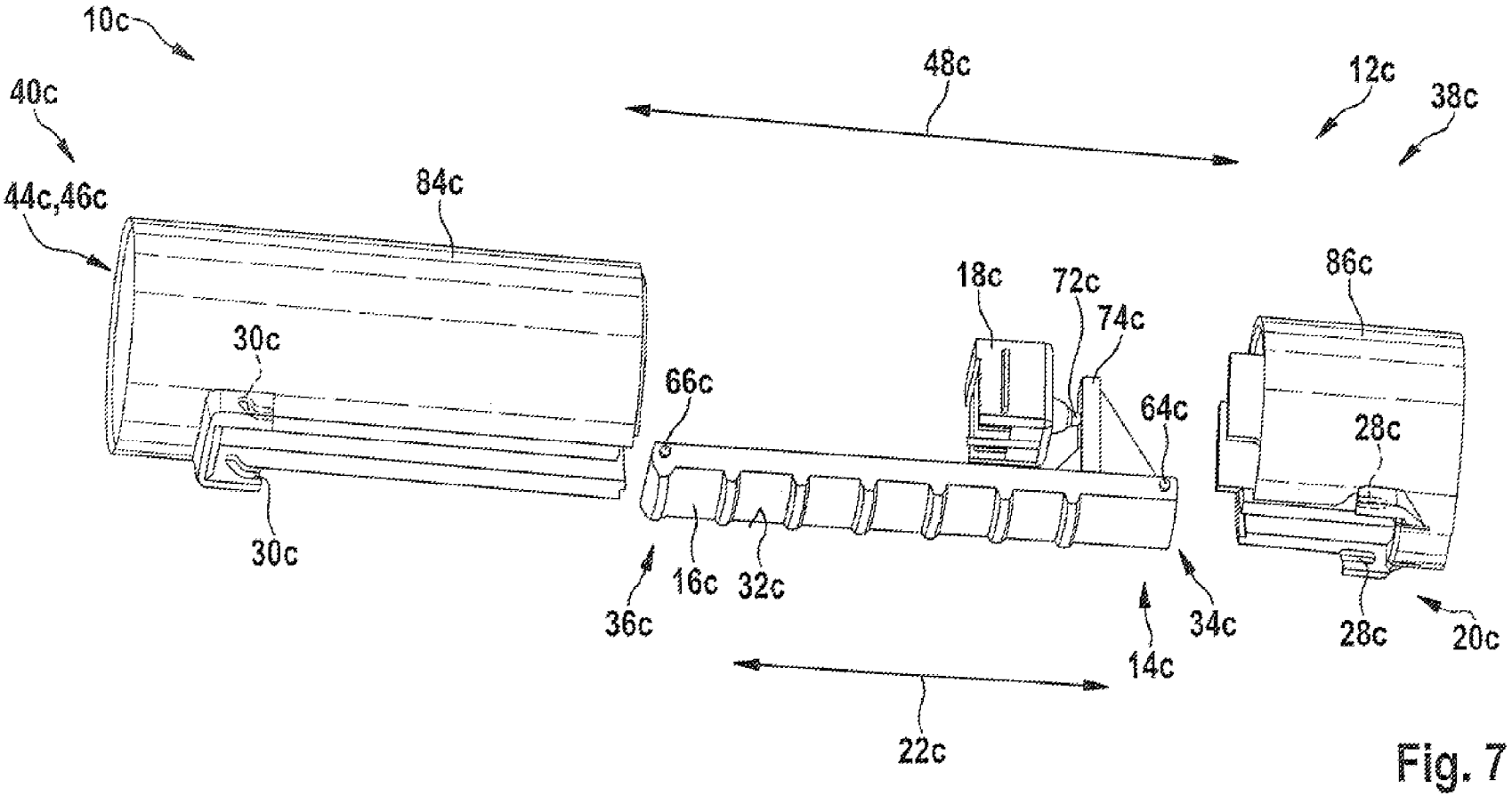
FIG. 7 shows, in a schematic representation, an exploded view of the further alternative power tool switching device according to the disclosure from FIG. 6, when the control element is in a switch-on position.

The guide unit 20*c* has two guide elements 28*c* that, when the control element 16*c* is an initial position, run at least substantially parallel to a direction of main extent 22*c* of the control element 16*c* (FIG. 7). The guide elements 28*c* are each realized as a groove, which groove is open for the purpose of mounting the control element 16*c* in the direction of a transmission housing (not represented here in greater detail) of a power tool housing 40*c* of the angle grinder 38*c*. In addition, the guide unit 20*c* has two further guide elements 30*c*, realized as grooves, which each have a guide track course that is at least partially angled relative to the direction of main extent 22*c* of the control element 16*c*, when the control element 16*c* is in an initial position (FIG. 7). The further guide elements 30*c* in this case each have a partial region 80*c* that runs at least substantially parallel to the direction of main extent 22*c* of the control element 16*c* when the control element 16*c* is in the initial position, and have a further partial region 82*c* that is angled relative to the partial region 80*c* that runs at least substantially parallel to the direction of main extent 22*c* of the control element 16*c*. For the purpose of mounting the control element 16*c*, the partial region 80*c* that runs at least substantially parallel to the direction of main extent 22*c* of the control element 16*c* when the control element 16*c* is in the initial position is open in a direction that faces away from the transmission housing.

The guide elements 28*c* and the further guide elements 30*c* in this case are arranged, in a manner at least substantially similar to that of the guide elements 28*a* and the further guide elements 30*a* described in the description of FIGS. 1 to 3, on a motor housing 44*c*, or a main handle 46*c*, of the power tool housing 40*c*. The motor housing 44*c* is realized in two parts.

The motor housing 44*c* in this case comprises a housing part 84*c* in the form of a hollow cylinder, and comprises a further, pot-type housing part 86*c*, which can be positively connected to the housing part 84*c* that is in the form of a hollow cylinder (FIG. 7). The guide elements 28*c* that run at least substantially parallel to the direction of main extent 22*c* of the control element 16*c* when the control element 16*c* is in the initial position are formed on to the pot-type housing part 86*c*. The further guide elements 30*c*, which have a guide track course that is at least partially angled relative to the direction of main extent 22*c* of the control element 16*c* when the control element 16*c* is in the initial position, are formed on to the housing part 84*c* that is in the form of a hollow cylinder.

Furthermore, a switching unit 14*c* comprises at least one blocking element 24*c*, which is provided, upon an actuation of the control element 16*c*, to block a movement of the control element 16*c* along a direction running at least substantially perpendicular to the direction of main extent 22*c* of the control element 16*c*. The blocking element 24*c* in this case is constituted by peripheral regions of the partial regions 80*c* of the guide elements 30*c* that run at least substantially parallel to the direction of main extent 22*c* of the control element 16*c* when the control element 16*c* is in the initial position.

Figure 8:
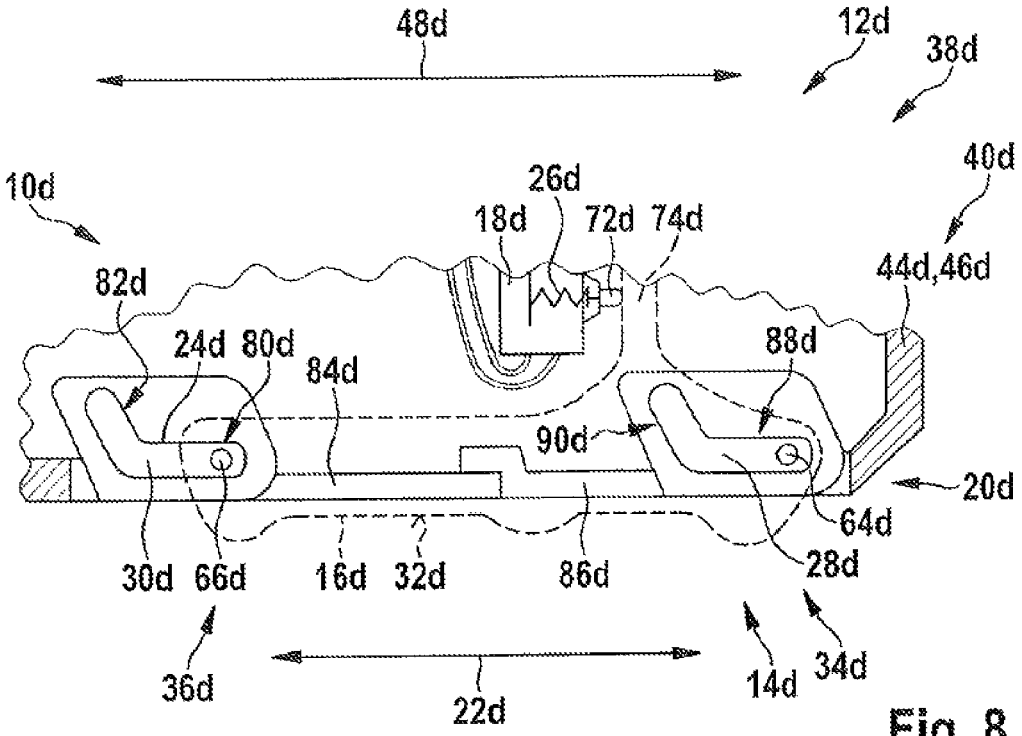
FIG. 8 shows, in a schematic representation, a detail view of a further alternative power tool switching device according to the disclosure, when a control element of a switching unit of the alternative power tool switching device according to the disclosure is in an initial position.

FIG. 8 shows a detail view of a further alternative power tool switching device 10*d* when a control element 16*d* of a switching unit 14*d* of the power tool switching device 10*d* is in an initial position. The power tool switching device 10*d* in this case is arranged in an angle grinder 38*d*, which comprises the power tool switching device 10*d*. The angle grinder 38*d*, not represented in greater detail, is of a structure at least substantially similar to that of the angle grinder 38*a* from FIG. 1. The power tool switching device 10*d* comprises at least the switching unit 14*d*, which comprises at least the movably mounted control element 16*d* for the purpose of actuating a mechanical, electrical and/or electronic switching element 18*d* of the switching unit 14*d*. In addition, the power tool switching device 10*d* has a guide unit 20*d*, which is provided, upon an actuation of the control element 16*d* along a direction of main extent 22*d* of the control element 16*d*, to convert a movement of the control element 16*d* along the direction of main extent 22*d* at least into a movement of the control element 16*d* running transversely in relation to the direction of main extent 22*d*.

The guide unit 20*d* has two guide elements 28*d*, realized as grooves, and has two further guide elements 30*d*, realized as grooves, which each have a guide track course that is at least partially angled relative to the direction of main extent 22*d* of the control element 16*d*, when the control element 16*d* is in the initial position. The guide elements 28*d* and the further guide elements 30*d* in this case each have a partial region 80*d*, 88*d* that runs at least substantially parallel to the direction of main extent 22*d* of the control element 16*d* when the control element 16*d* is in the initial position, and have a further partial region 82*d*, 90*d* that is angled relative to the partial region 80*d*, 88*d* that runs at least substantially parallel to the direction of main extent 22*d* of the control element 16*d*. Peripheral regions of the partial regions 80*d*, 88*d* that run at least substantially parallel to the direction of main extent 22*d* of the control element 16*d* when the control element 16*d* is in the initial position together constitute a blocking element 24*d* of the switching unit 14*d*. It is conceivable for the guide elements 28*d*, realized as grooves, and the further guide elements 30*d*, realized as grooves, to be open on one side for the purpose of mounting the control element 16*d*. The guide elements 28*d* and the further guide elements 30*d* in this case are arranged on a motor housing 44*d*, or on a main handle 46*d* of a power tool housing 40*d*, in a manner that is at least substantially similar to an arrangement of the guide elements 28*c* and the further guide elements 30*c*, described in the description of FIGS. 6 and 7, on the motor housing 44*c*, or on the main handle 46*c* of the power tool housing 40*c*.

Figure 9:
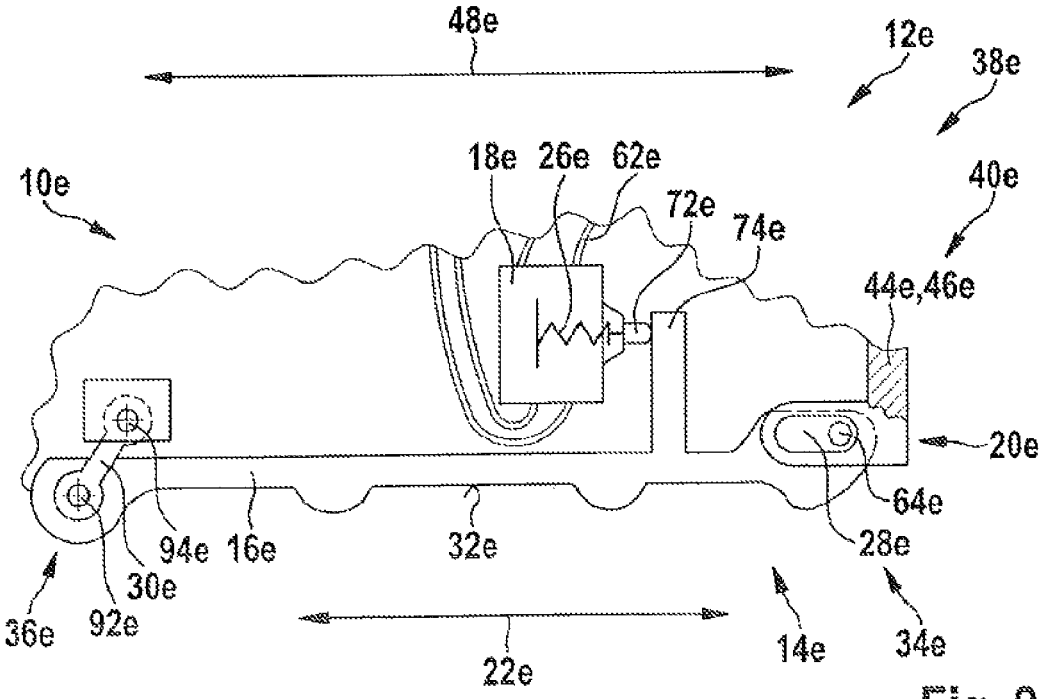
FIG. 9 shows, in a schematic representation, a detail view of a further alternative power tool switching device according to the disclosure, when a control element of a switching unit of the alternative power tool switching device according to the disclosure is in an initial position.
Figure 10:
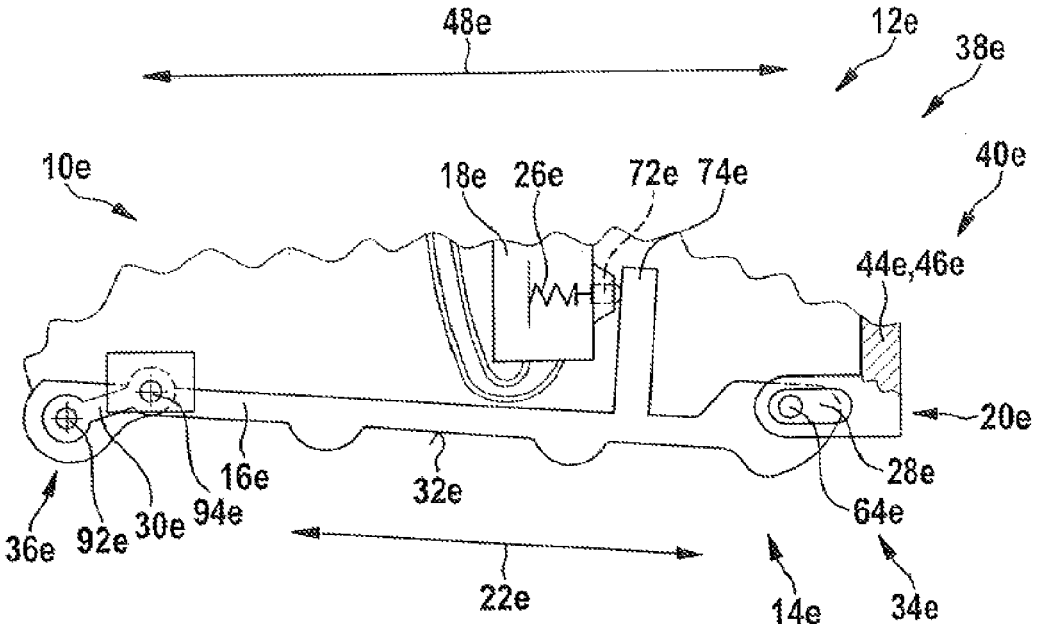
FIG. 10 shows, in a schematic representation, a detail view of the further alternative power tool switching device according to the disclosure from FIG. 9, when the control element is in a switch-on position.

FIG. 9 shows a detail view of a further alternative power tool switching device 10*e* when a control element 16*e* of a switching unit 14*e* of the power tool switching device 10*e* is in an initial position. The power tool switching device 10*e* in this case is arranged in an angle grinder 38*e*, which comprises the power tool switching device 10*e*. The angle grinder 38*e*, not represented in greater detail, is of a structure at least substantially similar to that of the angle grinder 38*a* from FIG. 1. The power tool switching device 10*e* comprises at least the switching unit 14*e*, which comprises at least the movably mounted control element 16*e* for the purpose of actuating a mechanical, electrical and/or electronic switching element 18*e* of the switching unit 14*e*. The switching unit 14*e* comprises at least one blocking element (not represented here), which is provided to block a movement of the control element 16*e* in at least one direction, in at least one operating state. The blocking element in this case can be realized in a manner similar to that of the blocking element 24*a* described in the description of FIGS. 1 to 3. In addition, the power tool switching device 10*e* has a guide unit 20*e*, which is provided, upon an actuation of the control element 16*e* along a direction of main extent 22*e* of the control element 16*e*, to convert a movement of the control element 16*e* along the direction of main extent 22*e* at least into a movement of the control element 16*e* running transversely in relation to the direction of main extent 22*e*.

The guide unit 20*e* has two guide elements 28*e* that, when the control element 16*e* is in the initial position, run at least substantially parallel to the direction of main extent 22*e* of the control element 16*e* (FIG. 9 shows only one of the two guide elements 28*e*). The guide elements 28*e* are realized as grooves. It is conceivable for the guide elements 28*e*, realized as grooves, to be open on one side for the purpose of mounting the control element 16*d*. When the control element 16*e* is in a mounted state, the guide elements 28*e* are arranged at an end 34*e* of the control element 16*e* that faces away from a transmission housing (not represented in greater detail here) of a power tool housing 40*e* of the angle grinder 38*e*. For the purpose of guiding a movement of the control element 16*e*, the guide unit 20*e* comprises engagement elements 64*e*, arranged on the control element 16*e*, which engage in the guide elements 28*e*. In addition, the guide unit 20*e* comprises two further guide elements 30*e* that, when the control element 16*e* is in a mounted state, are arranged at an end 36*e* of the control element 16*e* that faces toward the transmission housing (FIG. 9 shows only one of the two further guide elements 30*e*). The further guide elements 30*e* are realized as pendulum rods. The further guide elements 30*e*, realized as pendulum rods, are movably mounted on the control element 16*e*. The control element 16*e* in this case comprises trunnions 92*e*, on each of which one of the further guide elements 30*e* is movably mounted. In addition, the further guide elements 30*e*, realized as pendulum rods, are arranged in a movable manner on an inside of a motor housing 44*e*, or of a main handle 46*e* of the power tool housing 40*e*, that faces toward the control element 16*e*. The motor housing 44*e*, or the main handle 46*e*, in this case comprises trunnions 94*e*, on each of which one of the further guide elements 30*e* is movably mounted. The guide elements 28*e* and the further guide elements 30*e* are arranged relative to each other in a manner at least substantially similar to that of the guide elements 28*a* and the further guide elements 30*a* described in the description of FIGS. 1 to 3.

Upon an actuation of the control element 16*e*, starting from the initial position of the control element 16*e*, along the direction of main extent 22*e* of the control element 16*e*, the further guide elements 30*e*, realized as pendulum rods, are moved relative to the control element 16*e* and relative to the power tool housing 40*e*. By means of a combined action of the guide elements 28*e* that, when the control element 16*e* is in the initial position, run at least substantially parallel to the direction of main extent 22*e* of the control element 16*e*, and that are realized as grooves, and the further guide elements 30*e*, realized as pendulum rods, a movement resulting from an actuation of the control element 16*e* along the direction of main extent 22*e* of the control element 16*e* a movement of the control element 16*e* along the direction of main extent 22*e* is converted at least into a movement of the control element 16*a* running transversely in relation to the direction of main extent 22*e*. As a result, the control element 16*e* is moved from the initial position into a switch-on position (FIG. 10) by means of a translational movement, which is superimposed by a swivel movement about a swivel axis running at least substantially perpendicular to the direction of main extent 22*e*. The guide unit 20*e* is thus realized as a combination of a slideway guide unit and a pendulum rod guide unit.

Figure 11:
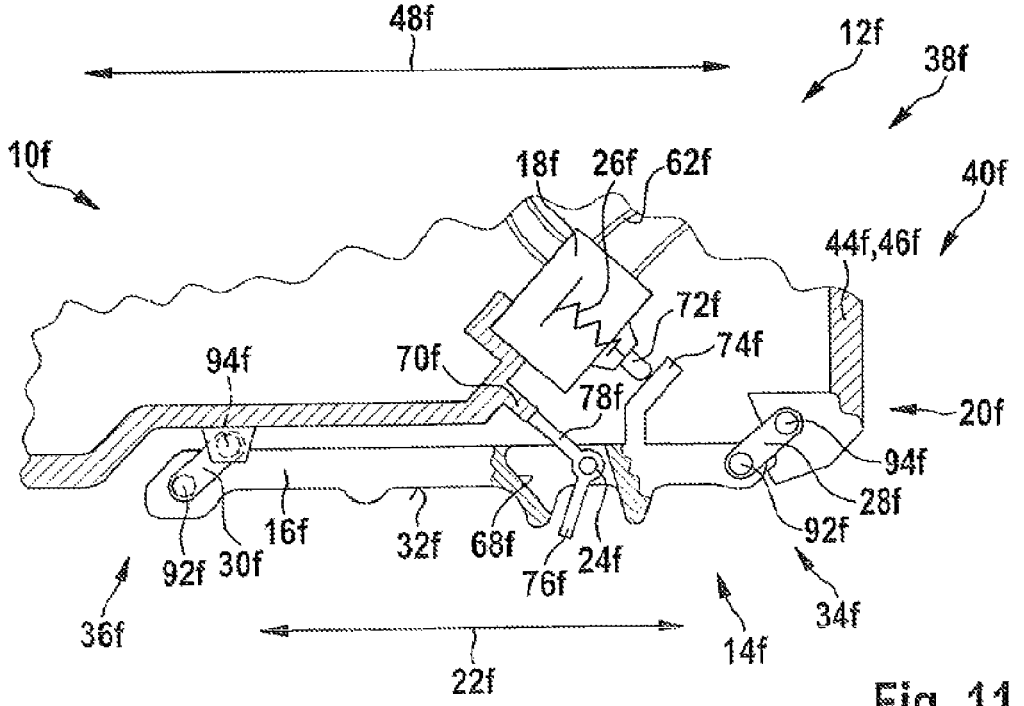
FIG. 11 shows, in a schematic representation, a detail view of a further alternative power tool switching device according to the disclosure, when a control element of a switching unit of the alternative power tool switching device according to the disclosure is in an initial position.

FIG. 11 shows a detail view of a further alternative power tool switching device 10*f* when a control element 16*f* of a switching unit 14*f* of the power tool switching device 10*f* is in an initial position. The power tool switching device 10*f* in this case is arranged in an angle grinder 38*f*, which comprises the power tool switching device 10*f*. The angle grinder 38*f*, not represented in greater detail, is of a structure at least substantially similar to that of the angle grinder 38*a* from FIG. 1. The power tool switching device 10*f* comprises at least the switching unit 14*f*, which comprises at least the movably mounted control element 16*f* for the purpose of actuating a mechanical, electrical and/or electronic switching element 18*f* of the switching unit 14*f*. In addition, the power tool switching device 10*f* comprises a guide unit 20*f*, which is provided, upon an actuation of the control element 16*f* along a direction of main extent 22*f* of the control element 16*f*, to convert a movement of the control element 16*f* along the direction of main extent 22*f* at least into a movement of the control element 16*f* running transversely in relation to the direction of main extent 22*f*.

The guide unit 20*f* has two guide elements 28*f* realized as pendulum rods (FIG. 11 shows only one of the two guide elements 28*f*). When the control element 16*f* is in a mounted state, the guide elements 28*f* are arranged at an end 34*f* of the control element 16*f* that faces away from a transmission housing (not represented in greater detail here) of a power tool housing 40*f* of the angle grinder 38*f*. In addition, the guide unit 20*f* comprises two further guide elements 30*f* that, when the control element 16*f* is in a mounted state, are arranged at an end 36*f* of the control element 16*f* that faces toward the transmission housing (FIG. 11 shows only one of the two further guide elements 300. The further guide elements 30*f* are likewise realized as pendulum rods. The guide elements 28*f*, realized as pendulum rods, and the further guide elements 30*f*, realized a pendulum rods, are movably mounted on the control element 16*f*. The control element 16*f* in this case comprises trunnions 92*f*, on each of which one of the guide elements 28*f* or the further guide elements 30*f* is movably mounted. In addition, the guide elements 28*f*, realized as pendulum rods, and the further guide elements 30*f*, realized as pendulum rods, are arranged in a movable manner on an inside of a motor housing 44*f*, or of a main handle 46*f* of the power tool housing 40*f*, that faces toward the control element 16*f*. The motor housing 44*f*, or the main handle 46*f*, in this case comprises trunnions 94*f*, on each of which one of the guide elements 28*f* or the further guide elements 30*f* is movably mounted. The guide unit 20*f* is thus realized as a pendulum rod guide unit. The guide elements 28*f* and the further guide elements 30*f* are arranged relative to each other in a manner at least substantially similar to that of the guide elements 28*a* and the further guide elements 30*a* described in the description of FIGS. 1 to 3.

Figure 12:
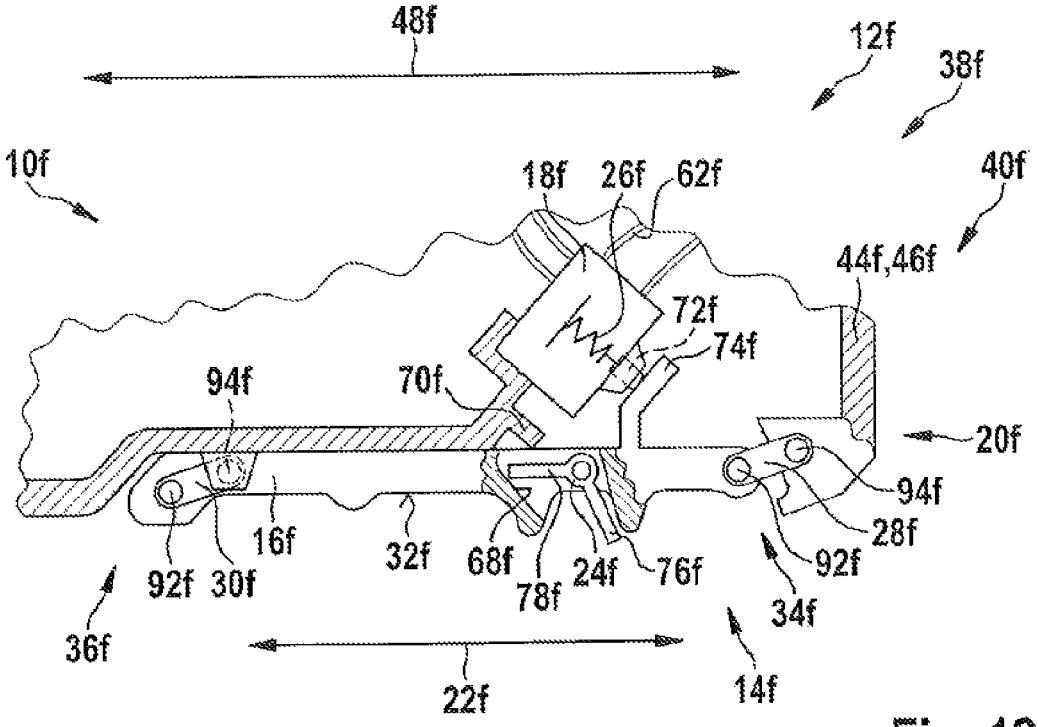
FIG. 12 shows, in a schematic representation, a detail view of the further alternative power tool switching device according to the disclosure from FIG. 11, when the control element is in a switch-on position.

In addition, for the purpose of actuating an actuating striker 72*f* of the switching element 18*f*, the control element 16*f* comprises an actuating extension 74*f*, which is arranged relatively obliquely in relation to the direction of main extent 22*f* of the control element 16*f*, on a side of the control element 16*f* that faces away from a control surface 32*f* of the control element 16*f*. The actuating extension 74*f* is provided to exert an actuating force upon the actuating striker 72*f* when the control element 16*f* is in a switch-on position (FIG. 12). In addition, the switching unit 14*f* comprises a blocking element 24*f*, which is movably arranged on the control element 16*f*. The blocking element 24*f* in this case is of a design similar to the design of the blocking element 24*a* described in the description of FIGS. 1 to 3.

What is claimed is:

1. A power tool switching device, comprising:

at least one switching unit having at least one movably mounted control element configured to actuate a mechanical, electrical and/or electronic switching element, the switching element configured to supply electrical power to a power tool; and at least one guide unit, which, upon an actuation of the control element along a direction of main extent of the control element, is configured to convert a movement of the control element along the direction of main extent at least into a movement of the control element running transversely in relation to the direction of main extent, wherein the control element has at least two ends that face away from each other as viewed along the direction of main extent, wherein at least one guide element of the guide unit is arranged at one end, and wherein at least one further guide element of the guide unit is arranged at a further end that faces away from the end when the control element is in the mounted state.

2. The power tool switching device according to claim 1, wherein the switching unit has at least one blocking element configured to block a movement of the control element in at least one direction in at least one operating state.

3. The power tool switching device according to claim 1, wherein the switching unit has at least one spring element configured to apply a spring force to the control element in at least one operating position.

4. The power tool switching device according to claim 1, wherein the guide unit is embodied as one or more of a slideway guide unit and a pendulum rod guide unit.

5. The power tool switching device according to claim 1, wherein the guide unit has at least one guide element configured to mount the control element in a swiveling manner.

6. The power tool switching device according to claim 5, wherein the guide unit has at least one further guide element embodied as a groove, which has a guide track course that is at least partially angled relative to the direction of main extent of the control element at least when the control element is in an initial position.

7. The power tool switching device according to claim 4, wherein the guide unit has at least one guide element embodied as a pendulum rod.

8. The power tool switching device according to claim 7, wherein the guide element embodied as a pendulum rod is movably mounted on the control element.

9. A portable power tool, comprising:

a power tool switching device including:

at least one switching unit having at least one movably mounted control element configured to actuate a mechanical, electrical and/or electronic switching element, the switching element configured to supply electrical power to the portable power tool; and at least one guide unit, which, upon an actuation of the control element along a direction of main extent of the control element, is configured to convert a movement of the control element along the direction of main extent at least into a movement of the control element running transversely in relation to the direction of main extent, wherein the control element has at least two ends that face away from each other as viewed along the direction of main extent, wherein at least one guide element of the guide unit is arranged at one end, and wherein at least one further guide element of the guide unit is arranged at a further end that faces away from the end when the control element is in the mounted state.

10. The power tool switching device according to claim 1, wherein the power tool switching device is configured for portable power tools.

* * * * *